US010016100B1

(12) United States Patent
Juc

(10) Patent No.: US 10,016,100 B1
(45) Date of Patent: Jul. 10, 2018

(54) PORTABLE URINAL DEVICE

(71) Applicant: Andrei Juc, Dickinson, ND (US)

(72) Inventor: Andrei Juc, Dickinson, ND (US)

( * ) Notice: Subject to any disclaimer, the term of this patent is extended or adjusted under 35 U.S.C. 154(b) by 0 days.

(21) Appl. No.: 15/484,392

(22) Filed: Apr. 11, 2017

(51) Int. Cl.

| | |
|---|---|
| ***A47K 11/00*** | (2006.01) |
| ***A47K 11/12*** | (2006.01) |
| ***B05B 9/04*** | (2006.01) |
| ***B05B 12/00*** | (2018.01) |

(52) U.S. Cl.
CPC ..... *A47K 11/12* (2013.01); *B05B 9/0403* (2013.01); *B05B 12/002* (2013.01)

(58) Field of Classification Search
CPC ..... A61G 9/006
See application file for complete search history.

(56) References Cited

U.S. PATENT DOCUMENTS

| | | | | | |
|---|---|---|---|---|---|
| 3,000,015 | A * | 9/1961 | Hart | A61G 9/006 | 4/144.3 |
| 3,070,810 | A * | 1/1963 | Jones | A47K 11/06 | 222/183 |
| 3,703,731 | A * | 11/1972 | Leiser | A47K 11/12 | 4/144.3 |
| D357,979 | S * | 5/1995 | Evans | A47K 11/12 | D24/122 |
| 6,021,531 | A * | 2/2000 | Kirko | A47K 11/12 | 4/144.1 |
| 6,493,883 | B2 * | 12/2002 | Jones | A47K 11/12 | 4/144.1 |
| 8,650,669 | B1 * | 2/2014 | Kolter | A47K 11/12 | 4/144.1 |
| 9,216,242 | B2 * | 12/2015 | Nishtala | A61B 5/14507 | |
| 9,339,155 | B1 * | 5/2016 | Parker | A47K 11/12 | |
| 9,339,409 | B2 * | 5/2016 | Brathwaite | A61F 5/4556 | |
| 9,603,737 | B2 * | 3/2017 | Jenkin | A61F 5/453 | |
| 2009/0249532 | A1 * | 10/2009 | Smith | B60R 15/04 | 4/114.1 |

* cited by examiner

*Primary Examiner* — Lori Baker

(57) ABSTRACT

A portable urinal device including a rectangular container and a moveable cone-shaped receptacle. The rectangular container has a moveable lid, a top side, a rear side, an interior front top chamber, an interior rear top chamber, and an interior bottom chamber. A water sprayer is medially located on the moveable lid of the rectangular container and is housed in the interior top front chamber. A water pump operated by an external electrical input is connected to the water sprayer. The moveable cone-shaped receptacle has a funnel and flexible hose. The moveable cone-shaped receptacle is stored in the interior top front chamber, and the flexible hose is attached to the interior bottom chamber. Lastly, each of a drain, drain hose connection and an electrical input device is located on the rear side of the rectangular container.

1 Claim, 4 Drawing Sheets

PORTABLE URINAL DEVICE

BACKGROUND OF THE INVENTION

Various types of urinal devices are known in the prior art. However, what has been needed is a portable urinal device including a rectangular container and a moveable cone-shaped receptacle. What has been further needed is for the rectangular container to have an interior front top chamber to hold the moveable cone-shaped receptacle, an interior rear top chamber to hold disinfectant, and an interior bottom chamber to collect urine. What has also been needed is a water pump in the interior front top chamber to be operable by an external electric source. Lastly, what has been needed is a hingeable top lid having a water sprayer connected to the water pump. The portable urinal device thus enables both male and female users to dispose of bodily liquid waste by clean and sterile means.

FIELD OF THE INVENTION

The present invention relates to urinal devices, and more particularly, to a portable urinal device.

SUMMARY OF THE INVENTION

The general purpose of the portable urinal device, described subsequently in greater detail, is to provide a portable urinal device that has many novel features that result in portable urinal device that is not anticipated, rendered obvious, suggested, or even implied by prior art, either alone or in combination thereof.

To accomplish this, the present portable urinal device has a rectangular container with a front side, a back side, a left side, a right side, a top side, a bottom side, an interior top front chamber, an interior top rear chamber, and an interior bottom chamber. The top side of the rectangular container has a front top side, a rear top side and a middle top side. A cap configured to mate with a threaded hole is medially located in the back top side of the rectangular top. The threaded hole leads to the interior top rear chamber of the rectangular container.

A retractable handle is embedded in the interior top rear chamber of the rectangular container. A moveable lid having a bottom surface has a perimeter equal to the perimeter of the front top side of the rectangular container. The moveable lid is hingeably attachable to the top side of the rectangular container. A water sprayer is medially disposed on the bottom surface of the moveable lid. The water sprayer is connected to a water pump located in the interior front chamber of the rectangular container. The water pump is configured to operate by an external electric source.

An electronic control panel has a pair of circular-shaped buttons configured to operate the device. The control panel is disposed on the front side of the rectangular container. Each of a plug and a drain hose connection are disposed on the back side of the rectangular container. A moveable cone-shaped receptacle configured to receive urine has an open funnel and a flexible hose. The flexible hose has a first end and a second end disposed opposite the first end. The first end of the flexible hose is releasably attachable to the bottom interior chamber, and the second end is configured to releasably receive the funnel shaped receptacle. The moveable cone-shaped receptacle is stored in the interior front end chamber of the rectangular container.

Thus has been broadly outlined the more important features of the portable urinal device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
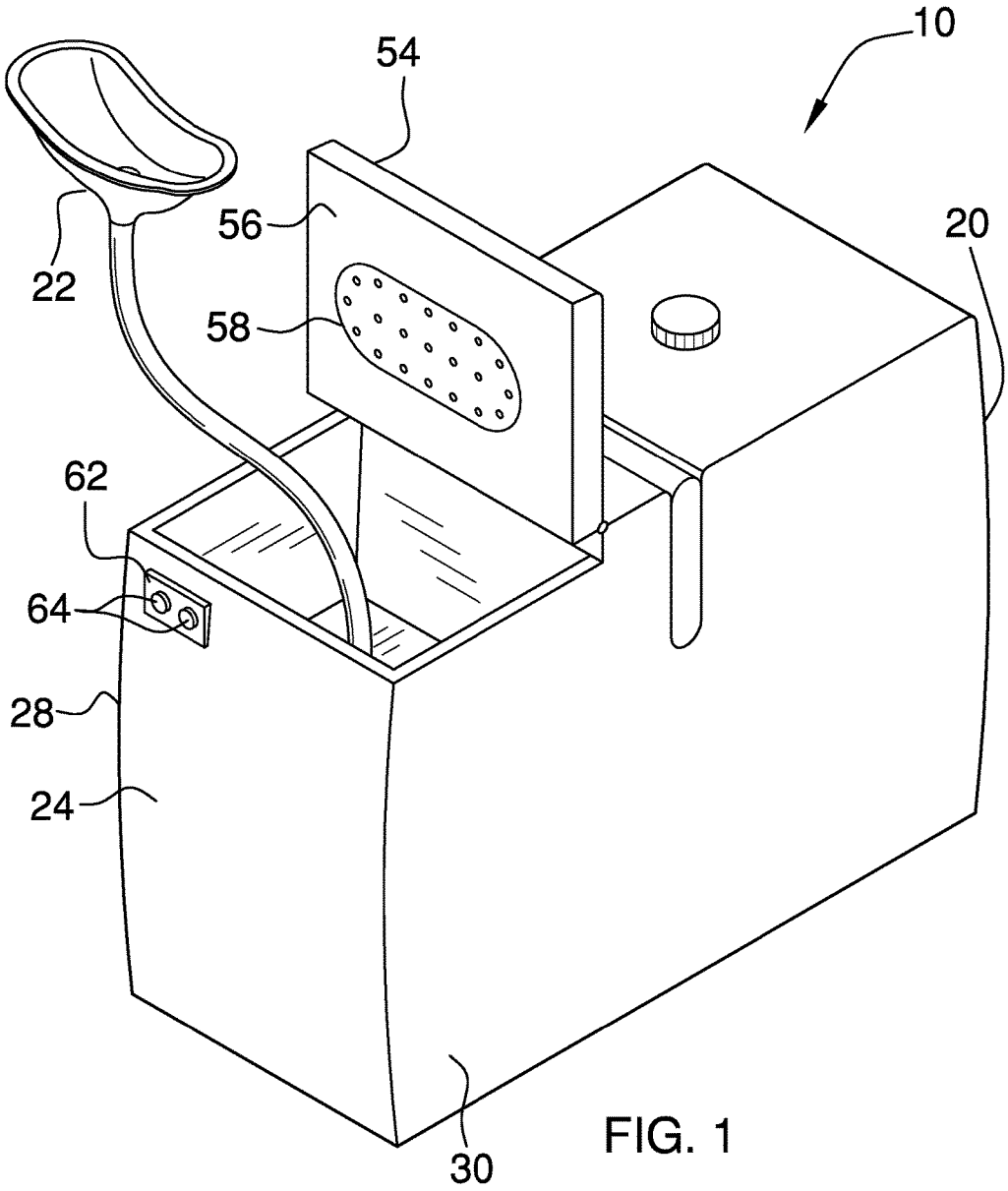
FIG. 1 is a front isometric view.
Figure 2:
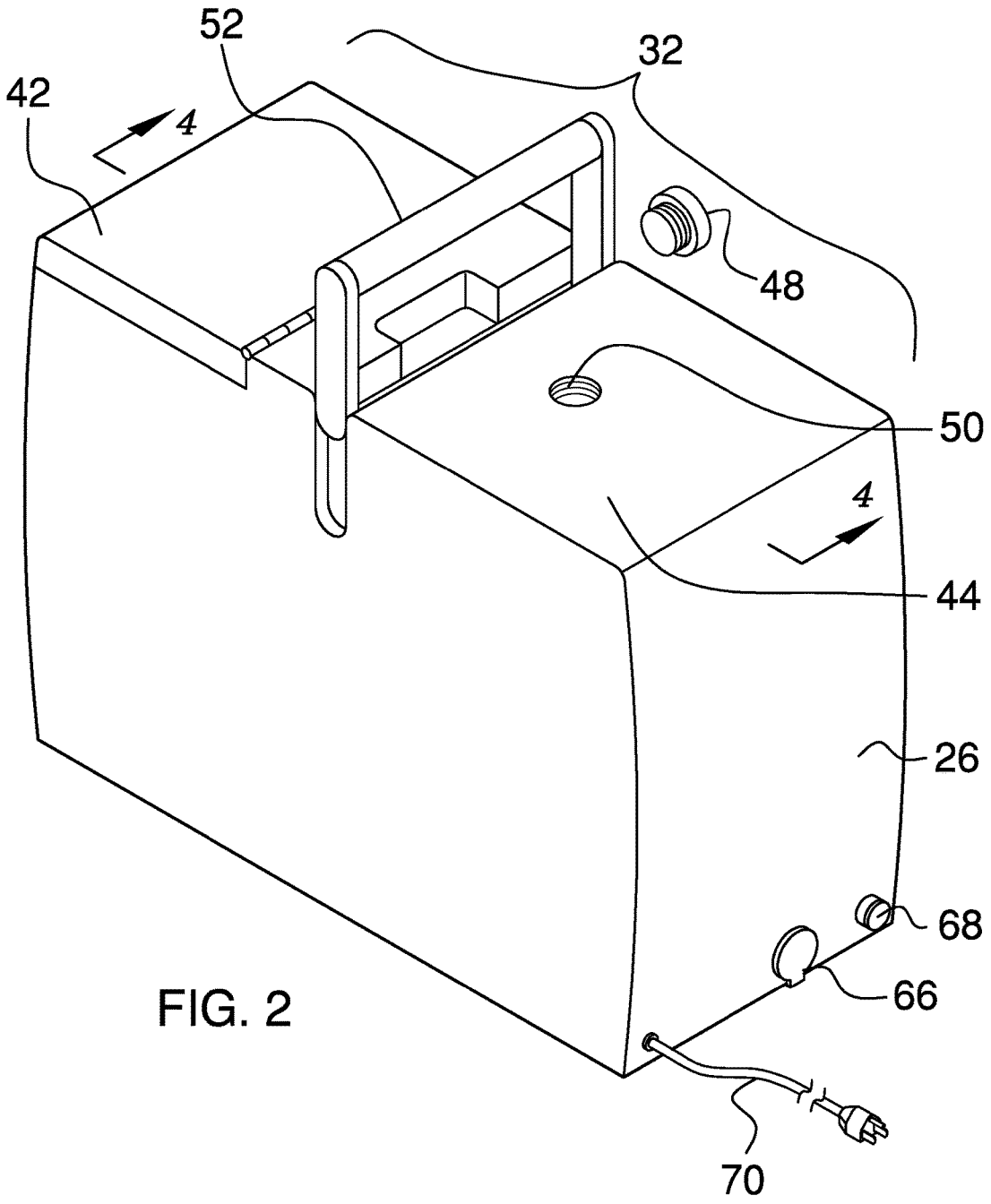
FIG. 2 is a rear isometric view.
Figure 3:
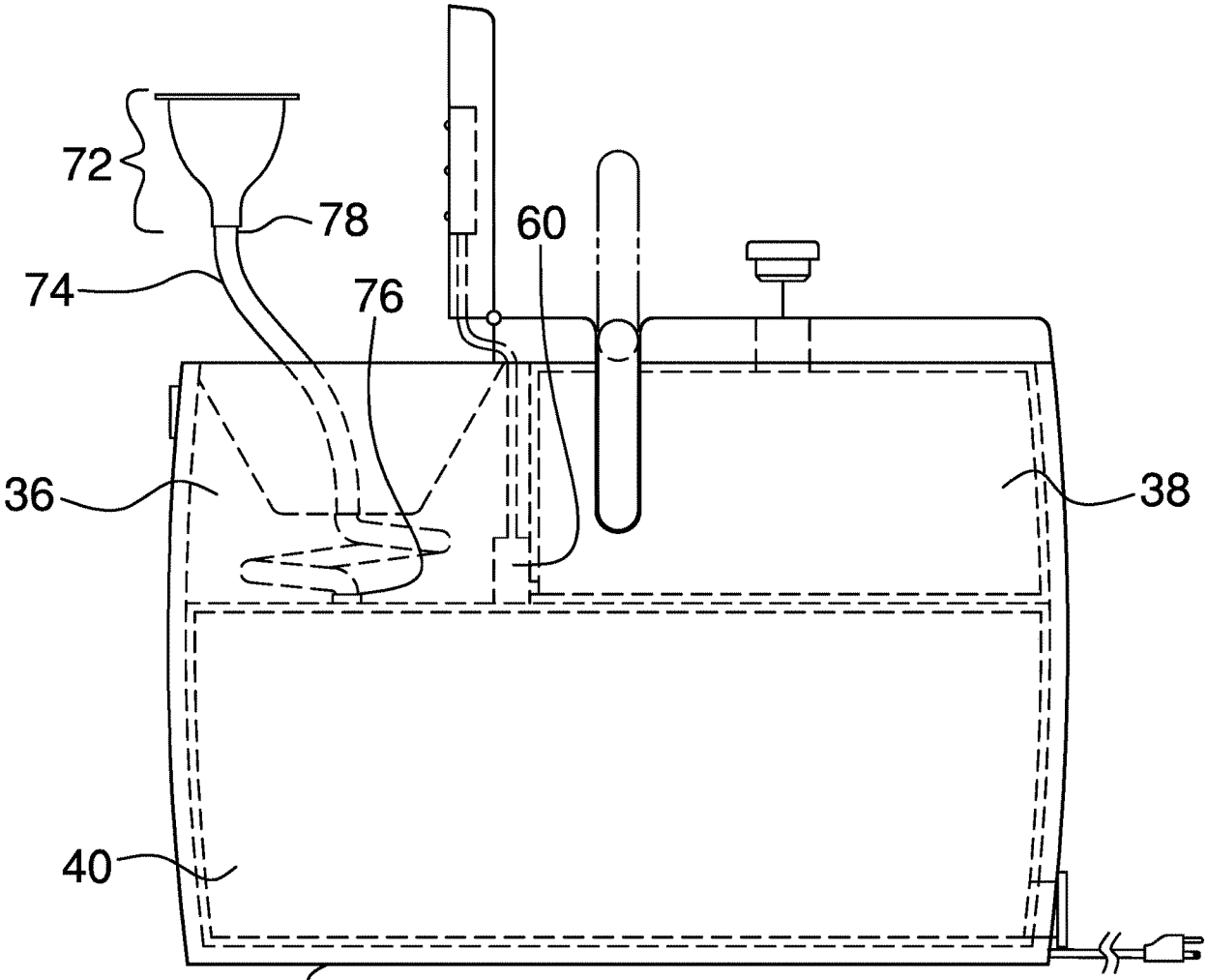
FIG. 3 is a side elevation view.
Figure 4:
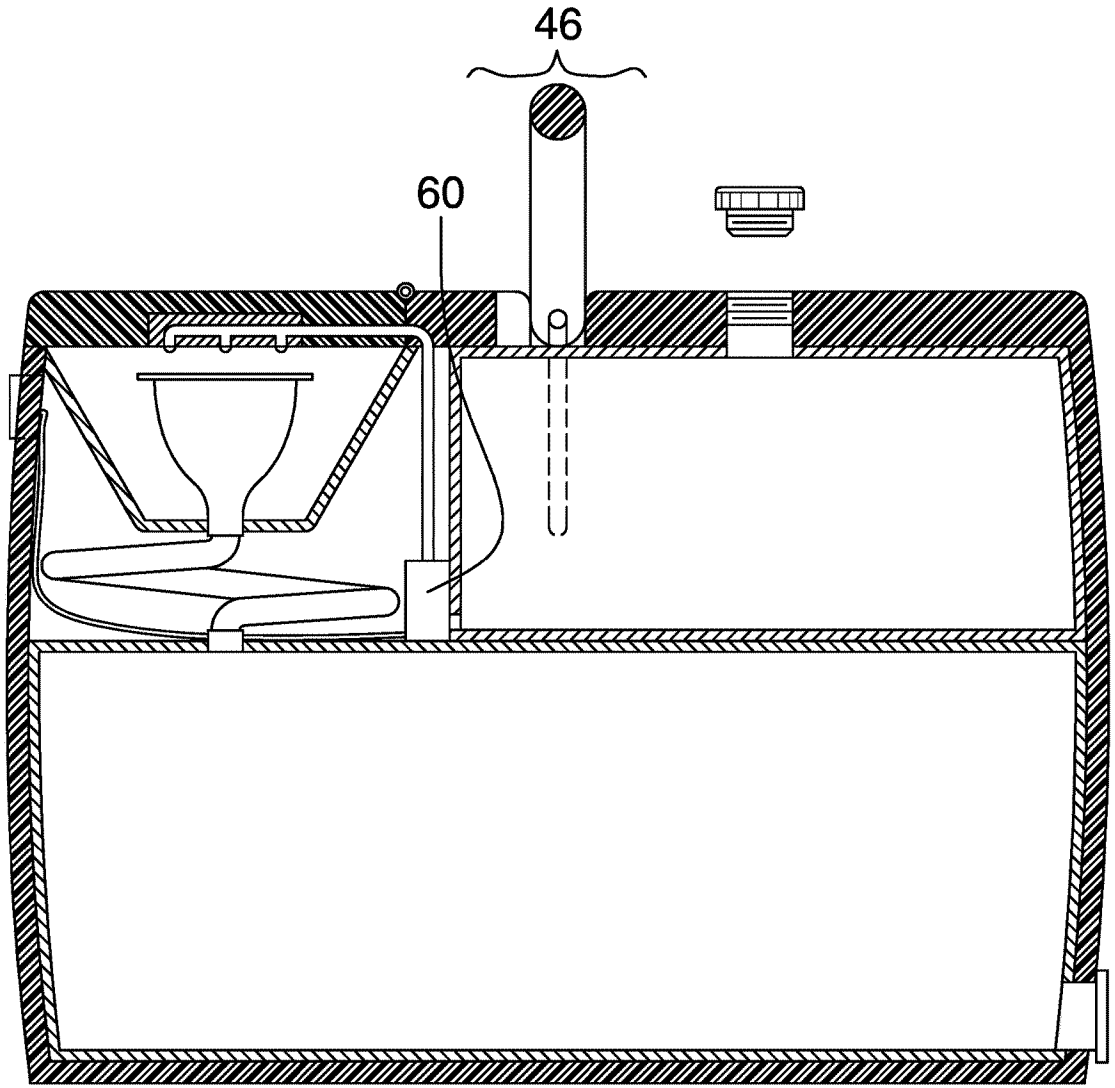
FIG. 4 is a cross-sectional side view.

With reference now to the drawings, and in particular FIGS. 1 through 4 thereof, an example of the instant portable urinal device employing the principles and concepts of the present portable urinal device and generally designated by the reference number 10 will be described.

Referring to FIGS. 1 through 5 the present portable urinal device 10 is illustrated. The portable urinal device 10 includes a rectangular container 20 and a moveable cone-shaped receptacle 22. The rectangular container 20 has a front side 24, a back side 26, a left side 28, a right side 30, a top side 32, a bottom side 34, an interior top front chamber 36, an interior top rear chamber 38, and an interior bottom chamber 40. The top side 32 of the rectangular container 20 has a front top side 42, a rear top side 44, and a middle top side 46. A cap 48 configured to mate with a threaded hole 50 medially disposed in the rear top side 44. The threaded hole 50 leads to the interior top rear chamber 38 of the rectangular container 20.

A retractable handle 52 is embedded in the interior top rear chamber 38 of the rectangular container 20. A moveable lid 54 with a bottom surface 56 has a perimeter equal to the perimeter of the front top side 24 of the rectangular container 20. The moveable lid 54 is hingeably attachable to the top side 32 of the rectangular container 20. A water sprayer 58 is medially disposed on the bottom surface 56 of the moveable lid 54. The water sprayer 58 is connected to a water pump 60 located in the interior front chamber 36 of the rectangular container 20. The water pump 60 is configured to operate by an external electric source.

An electronic control panel 62 has a pair of circular-shaped buttons 64 configured to operate the device 10. The control panel 62 is located on the front side 24 of the rectangular container 20. Each of a plug 66, a drain hose connection 68, and an electrical input cord 70 is on the back side 26 of the rectangular container 20.

A moveable cone-shaped receptacle 22 configured to receive urine has an open funnel 72 and a flexible hose 74. The flexible hose 74 has a first end 76 and a second end 78 disposed opposite the first end 76. The first end 76 of the flexible hose 74 is releasably attached to the interior bottom chamber 40, and the second end 78 is configured to releasably receive the cone-shaped receptacle 72. The moveable cone-shaped receptacle 22 is stored in the interior front end chamber 36 of the rectangular container 20.

Thus has been broadly outlined the more important features of the portable urinal device 10 so that the detailed description thereof that follows may be better understood and in order that the present contribution to the art may be better appreciated.

What is claimed is:

1. A portable urinal device, comprising:

a rectangular container having a front side, a back side, a left side, a right side, a top side, a bottom side, an interior top front chamber, an interior top rear chamber, and an interior bottom chamber, wherein the top side of the rectangular container has a front top side, a rear top side, and a middle top side;

a cap configured to mate with a threaded hole medially disposed in the back top side of the rectangular top, wherein the threaded hole leads to the interior top rear chamber of the rectangular container;

a retractable handle having a vertical left side, a vertical right side, and a center handle, wherein the retractable handle is disposed in the middle top side of the rectangular container and each of the vertical left side and the vertical right side is retractably embedded into the interior top rear chamber of the rectangular container;

a moveable lid having a bottom side, wherein the perimeter of the moveable lid is equal to the perimeter of the front top side of the rectangular container and the moveable lid is hingeably attachable to the top side of the rectangular container;

a water sprayer medially disposed on the bottom side of the moveable lid, wherein the water sprayer is connected to a water pump disposed in the interior front chamber of the rectangular container and the water pump is configured to operate from an outside electric power source;

an electronic control panel having a pair of circular-shaped buttons configured to operate the device, wherein the control panel is disposed on the front side of the rectangular container;

a plug securable to a threaded neck, a drain hose connection and an external electrical input cord, wherein each of the plug, the drain hose connection, and the electrical input cord is disposed on the back side of the rectangular container; and a moveable funnel-shaped receptacle configured to receive urine having an open funnel and a flexible hose, wherein the flexible hose has a first end and a second end disposed opposite the first end, wherein the first end is configured to releasably attach to the bottom interior chamber and the second end configured to releasably receive the funnel-shaped receptacle, wherein the moveable funnel-shaped receptacle is stored in the interior front end chamber of the rectangular container.

* * * * *